US006824350B2

(12) United States Patent
Pares Criville

(10) Patent No.: US 6,824,350 B2
(45) Date of Patent: Nov. 30, 2004

(54) HYDRODYNAMIC SEALING SYSTEM FOR CENTRIFUGAL SYSTEMS

(75) Inventor: Antonio Pares Criville, Barbera Del Valles (ES)

(73) Assignee: Careseal, S.L., Sabadell (ES)

( * ) Notice: Subject to any disclaimer, the term of this patent is extended or adjusted under 35 U.S.C. 154(b) by 0 days.

(21) Appl. No.: 10/373,517

(22) Filed: Feb. 25, 2003

(65) Prior Publication Data

US 2004/0165982 A1 Aug. 26, 2004

(51) Int. Cl.[7] ..... F04D 5/04

(52) U.S. Cl. ..... 415/98; 415/171.1; 415/230; 416/181

(58) Field of Search ..... 415/171.1, 230, 415/98; 416/181, 175, 198 R, 199, 203

(56) References Cited

U.S. PATENT DOCUMENTS 1,867,290 A * 7/1932 Vitu ..... 415/106
1,967,316 A * 7/1934 Meeker ..... 415/106
4,921,400 A * 5/1990 Niskanen ..... 415/169.1

* cited by examiner

*Primary Examiner*—Ninh H. Nguyen
(74) *Attorney, Agent, or Firm*—Steinberg & Raskin, P.C.

(57) ABSTRACT

A hydrodynamic sealing system for centrifugal systems comprising a double, asymmetric impeller attached to a rotary shaft, a fixed housing that surrounds the double impeller, a fluid inlet (5) in an axial direction and a fluid outlet in a radial direction with respect to the double impeller, with the double impeller defining a front side which receives the entry of fluid and a rear side close to the sealing zone of the shaft with the fixed housing. The double impeller is provided with means for taking the fluid from its front side to its rear side, so that when the double impeller rotates there arises a control of the pressure in the sealing zone, thus permitting balancing of the stresses on the double impeller and optimization of the sealing system.

5 Claims, 2 Drawing Sheets

HYDRODYNAMIC SEALING SYSTEM FOR CENTRIFUGAL SYSTEMS

This invention relates to a hydrodynamic sealing system for centrifugal systems, such as centrifugal pumps, which comprises a double, asymmetric impeller attached to a rotary shaft, a fixed housing that surrounds the double impeller, a fluid inlet in axial direction and a fluid outlet in radial direction with respect to the double impeller, with the double impeller defining a front side which receives the entry of fluid and a rear side close to the sealing zone of the shaft with the fixed housing.

BACKGROUND OF THE INVENTION

Known in the art are different types of sealing of centrifugal systems. A general description is provided below of two different types of sealing for centrifugal systems: hydrodynamic sealing systems and hermetic closure systems.

There currently exist hydrodynamic sealing systems of different types, which in all cases act by creating a strong negative pressure in the inlet zone of the shaft or sealing zone of the centrifugal system, which means that this zone remains dry when the system is in operation. This fact entails a number of requirements.

On the one hand, the entry of air from the exterior through the sealing system has to be prevented, which can be carried out by means of special dry-sealing systems, with the disadvantage that as the latter are not in contact with the pumping liquid they require the utilization of auxiliary cooling and lubrication systems.

On the other hand, all the known hydrodynamic sealing systems can cause heating of the liquids with the resulting loss of energy efficiency of the system.

One significant disadvantage is that it is impossible to combine these hydrodynamic sealing systems with the sealing systems which act by hermetically closing the aforesaid sealing zone.

The hermetic closure systems habitually used include metallic or non-metallic parts which, when placed under pressure, prevent leakage of the liquids to the exterior. These systems nevertheless present a number of disadvantages.

Firstly, construction of those parts is costly because the type of materials and machining precision required. The cost of manufacturing the hermetic closure systems often accounts for over one-third of the total cost of the equipment, while the system is very sensitive to poor pumping conditions and misalignments and imbalances.

Secondly, owing to the level of leaktightness required to prevent the pressurized liquid escaping from the equipment, the parts must be under pressure. The pressure to which the closure elements are subjected when the equipment is operating generates considerable abrasion, which leads to wear of those elements and heating in the sealing zone, thus negatively affecting the efficiency of the centrifugal system.

A particularly significant problem arises when for any reason the equipment is operating without pumping liquid, for owing to the heating up of the hermetic closure systems, the closure can become seized after a short time of operation.

Finally, as a result the abrasion and heating mentioned, the hermetic closure systems have a limited life, which leads to poor reliability and high maintenance costs.

DESCRIPTION OF THE INVENTION

The objective of the hydrodynamic sealing system of this invention for centrifugal systems is to solve the disadvantages presented by the systems known in the art, thanks to the possibility of combining the hydrodynamic sealing of the invention with any known type of hermetic closure means.

The hydrodynamic sealing system of this invention for centrifugal systems is characterized in that the double impeller is provided with means for taking the fluid from its front side to its rear side, so that when the double impeller rotates there arises a control of the pressure in the sealing zone, thus permitting balancing of the stresses on the impeller and optimization of the sealing system.

The main advantage of the invention when compared with the hydrodynamic sealing known in the art is that strong negative pressure is not created in the sealing zone, but instead a balancing of the pressures to the interior and exterior of this zone is achieved, which means that the liquid in the interior does not tend to come out and the air on the exterior does not tend to enter.

All this is implemented by keeping the sealing zone moistened by the pumping liquid, which is furthermore renewed, thereby avoiding the need to use seals for dry-sealing, which would in turn require auxiliary cooling systems.

Another advantage is that the rear part of the double impeller not only serves for carrying out the hydrodynamic sealing but, like the front part of the impeller, drives fluid to the exterior of the equipment.

Advantageously, the means for driving the fluid between the two sides of the double impeller include openings made in the core or intermediate wall of the double impeller, which depending on their position in relation to the shaft of the double impeller and their size permit the pressure in the sealing zone to be suitably regulated.

The pressure reduction in the sealing zone can therefore be regulated in accordance with the position and the size of the openings made for conveying the fluid between the two sides of the impeller.

Preferably, the hydrodynamic sealing system is applied to a centrifugal system which includes hermetic closure means for the sealing zone.

With the hydrodynamic sealing system proposed there exists the possibility of combination with all the known hermetic closure means, for the purpose of preventing leakages when the equipment is not operating.

Whatever the type of hermetic closure with which it is combined, as the pressures in the interior and exterior of the sealing zone are balanced, this hermetic closure does not have to act, and the working conditions can therefore be optimum, since only minimal pressure is needed between the contact surfaces.

In consequence, these closure means do not heat up and, therefore, the cooling requirements are minimal, it sufficing to renew the liquids produced by means of the hydrodynamic system in the sealing zone.

This minimal pressure of the closure means that in the event of absence of pumping liquid the equipment can go for lengthy periods without occurrence of heating which affects the closure and, therefore, without breakdowns.

As the pressure of the elements comprising the hermetic closure combined with the hydrodynamic system is minimal, abrasion and heating of the seal is reduced and as a result better response of the equipment is achieved in the event of cavitations, imbalances and misalignments, thereby increasing the reliability and durability of the equipment.

The hydrodynamic sealing system of the invention improves energy efficiency significantly, while at the same time improving pressure-flow performance (H-Q curve).

When the hermetic closure seal in equipment is a critical point due to high abrasion, equipment is chosen with a rotation speed of 1,450 r.p.m. in order to prevent the abrasion and heating which would exist with a speed of 2,900 r.p.m. With application of the hydrodynamic sealing system described, as the abrasion and heating of the hermetic closure are no longer high it is possible to choose equipment that works at 2,900 r.p.m., thereby achieving higher energy efficiency and greater assurance of system reliability.

Moreover, the hydrodynamic sealing system also reduces the axial stresses arising on the bearings of the rotary shaft of the double impeller.

Furthermore, the hydrodynamic sealing system of the invention can be applied in any known centrifugal system (DIN, ANSI, etc.).

According to one embodiment of the hydrodynamic sealing system of this invention, the double impeller has a closed front wall and a semi-open rear wall.

According to another embodiment of the hydrodynamic sealing system of this invention, the double impeller has a closed front wall and a closed rear wall.

According to another embodiment of the hydrodynamic sealing system of this invention, the double impeller has a closed rear wall.

BRIEF DESCRIPTION OF THE DRAWINGS

In order to facilitate description of all that has been described above drawings are attached which show, schematically and solely by way of non-restrictive example, of embodiment of the hydrodynamic sealing system for centrifugal systems, in which.

DESCRIPTION OF PREFERRED EMBODIMENTS

Figure 1:
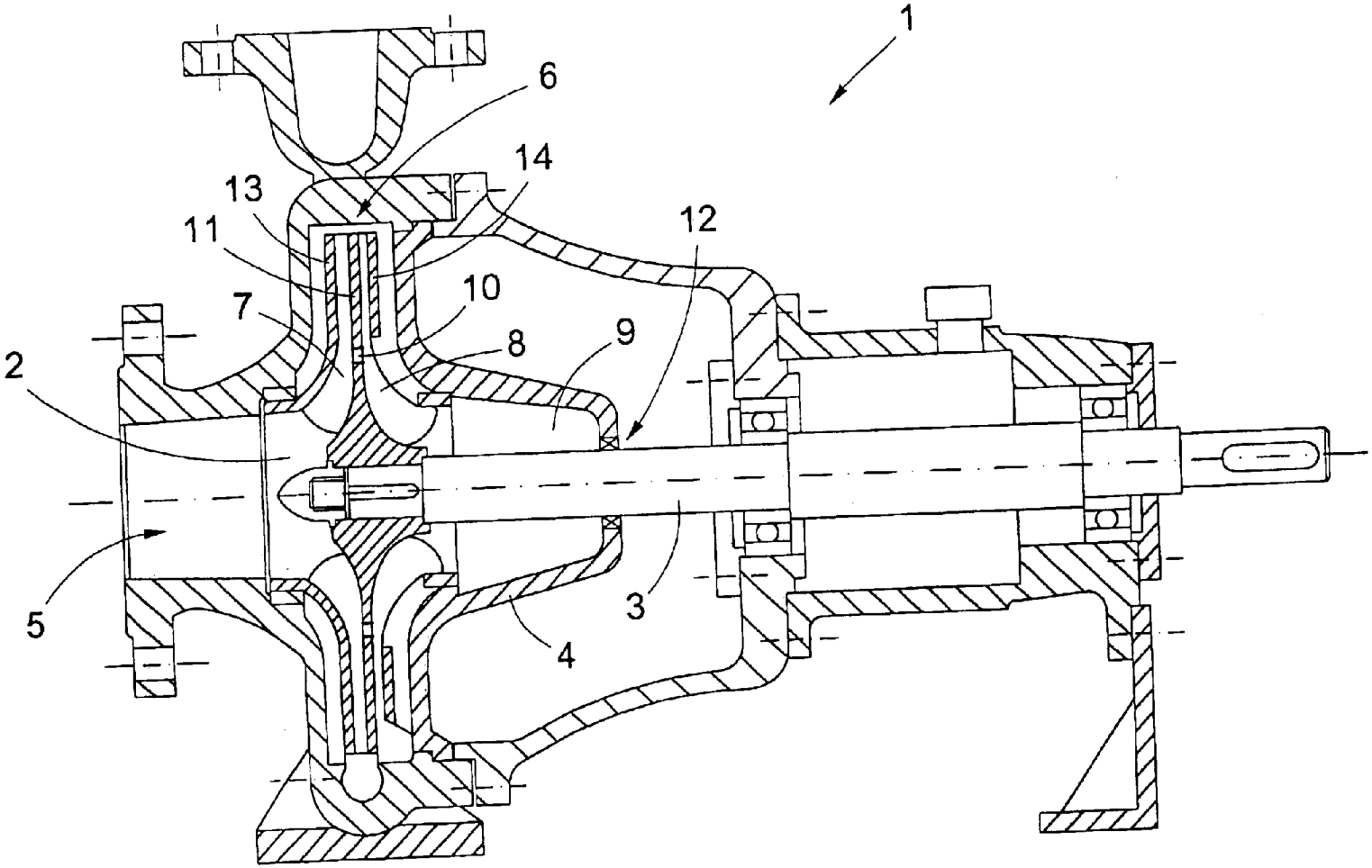
FIG. 1 is a longitudinal section of a centrifugal pump to which is applied the hydrodynamic sealing system of the invention according to a first embodiment.

FIG. 1 shows a centrifugal pump 1 to which is attached the hydrodynamic sealing system of the invention, which comprises a double, asymmetric impeller 2 attached to a rotary shaft 3, a fixed housing 4 which surrounds said double impeller 2, and a fluid inlet 5 in axial direction and a fluid outlet 6 in radial direction in relation to the double impeller 2.

The double impeller 2 has a front side 7 which receives the inlet 5 of fluid, and a rear side 8 close to the sealing zone 9 of the shaft 3 with the fixed housing 4.

Moreover, the double impeller 2 includes a plurality of orifices 10 made in the core or intermediate wall 11 thereof. The orifices 10, depending on their position in relation to the shaft of the double impeller 2 and their size, permit suitable regulation of pressure in the sealing zone 9.

Thus, when the double impeller 2 rotates pressure control takes place in the sealing zone 9, thus permitting the pressure of the interior of the sealing zone 9 to be balanced with the pressure from the exterior, which is generally atmospheric pressure.

Furthermore, the double impeller 2 permits the fluid to be impelled from both sides 7, 8 thereof towards the outlet 6 of the pump 1.

The centrifugal pump 1 also includes hermetic closure means 12 of the sealing zone 9, for the purpose of preventing leaks when the pump 1 is at a standstill. Moreover, the hydrodynamic sealing system of the invention permits combination with all known means of hermetic closure.

As FIG. 1 shows, in this first embodiment the double impeller 2 includes a closed front side 13 and a semi-open rear side 14.

The functioning of the hydrodynamic sealing system of the invention is as follows:

When the rotary shaft 3 is actuated by a motor the double impeller 2 is set into motion and as it rotates; it sucks in the pumping liquid from the inlet 5 to the outlet 6. Thanks to the fact that the impeller 2 has a double inlet 7, 8, in addition to suction of the liquid by the front part 7 of the double impeller 2, it also takes place from the rear side 8 thereof through the orifices 10.

This suction at the rear part 8 of the double impeller permits the pressure of the interior of the sealing zone 9 to be balanced with the pressure from the exterior, so that the liquid in the interior does not tend to go out, nor the air from the exterior to enter, so that it is not necessary to use complex hermetic closure means.

Furthermore, problems of heating of the rotary shaft 3 are avoided, so the use of cooling means is not necessary either.

Thus, thanks to the hydrodynamic sealing system of the invention, it is possible to use any known type of hermetic closure means for the sealing zone 9.

The balancing of pressures in the interior and exterior of the sealing zone 9 which is obtained when the pump is operating provides optimum working conditions.

Figure 2:
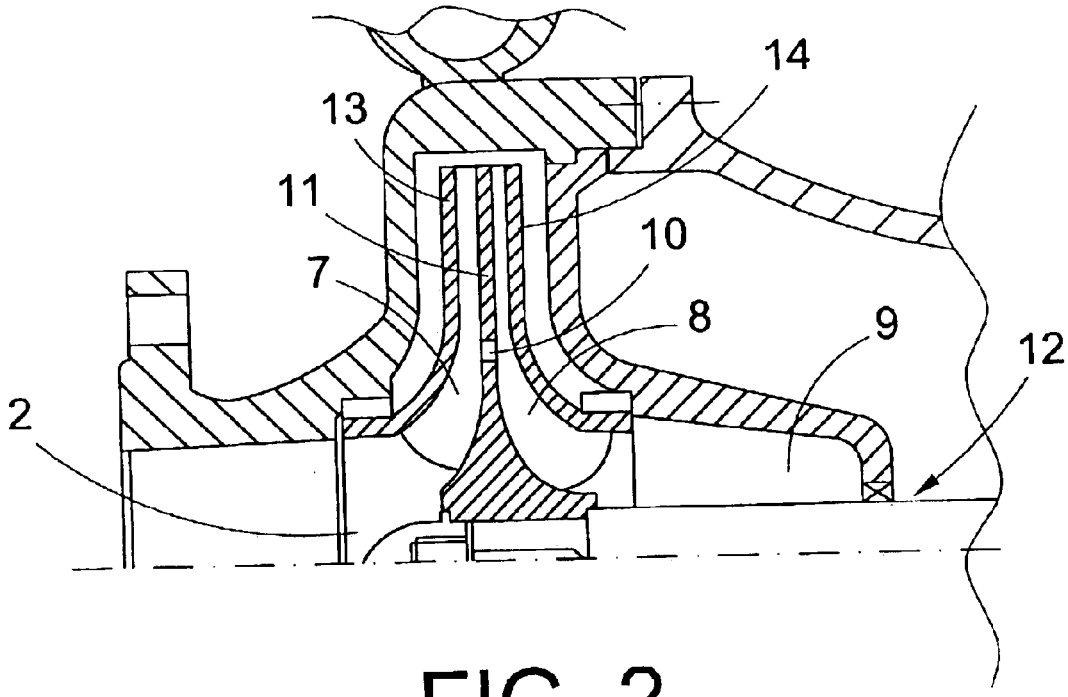
FIG. 2 is a longitudinal section of the hydrodynamic sealing system of the invention according to a second embodiment.

FIG. 2 shows a second embodiment of the hydrodynamic sealing system of the invention, in which it can be seen that the double impeller 2 includes a closed front wall 13 and a closed rear wall 14.

Figure 3:
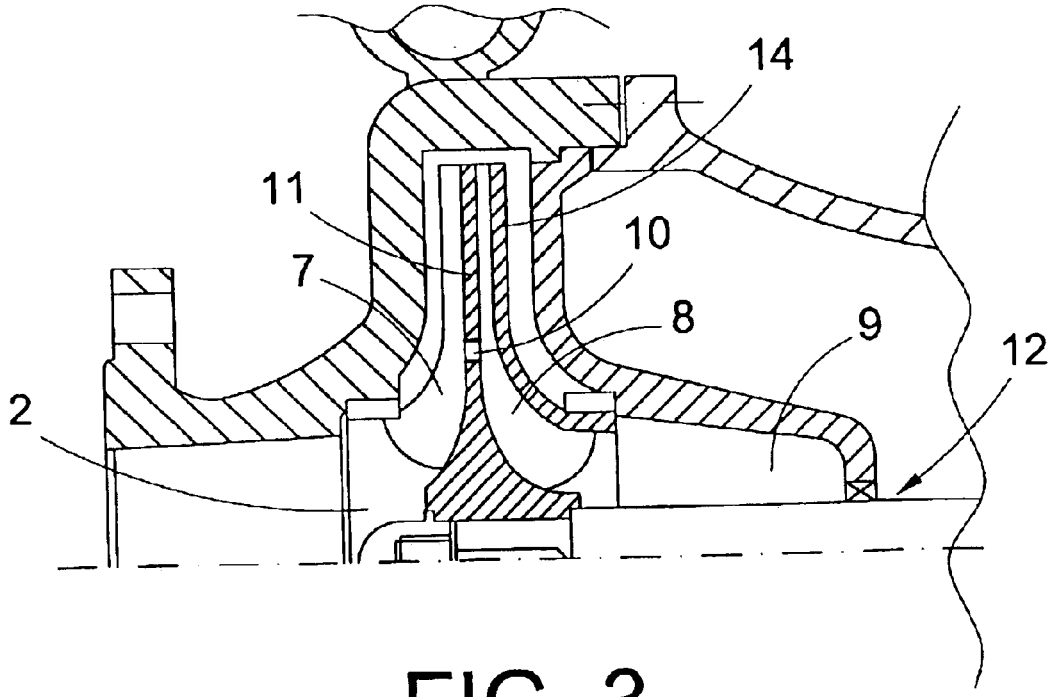
FIG. 3 is a longitudinal section of the hydrodynamic sealing system of the invention according to a third embodiment.

FIG. 3 shows a third embodiment of the hydrodynamic sealing system of the invention, in which it can be seen that the double impeller 2 includes a closed rear wall 14.

Independent of the object of this invention are the materials used in manufacturing of the parts making up the hydrodynamic sealing system for centrifugal systems described, as are the shapes and dimension thereof and all accessory details which might be presented, which can be replaced by others that are technically equivalent, as long as they do not affect its essential nature nor depart from the sphere defined by the claims attached below.

What is claimed is:

1. Hydrodynamic sealing system for centrifugal systems, comprising:

a double, asymmetric impeller (2) attached to a rotary shaft (3), a fixed housing (4) that surrounds said double impeller (2), a fluid inlet (5) in axial direction and a fluid outlet (6) in radial direction with respect to the double impeller (2), with said double impeller (2) defining a front side (7) which receives the entry of fluid and a rear side (8) close to the sealing zone (9) of the shaft (3) with the fixed housing (4), wherein said double impeller (2) is provided with means (10) for taking the fluid from its front side (7) to its rear side (8), wherein the means for driving the fluid between the two sides (7, 8) of said double impeller include openings (10) made in a core or intermediate wall (11) of said double impeller (2), which depending on their position in relation to the shaft of said double impeller (2) and their size permit a pressure in the sealing zone (9) to be suitably controlled, so that the pressure is an atmospheric pressure.

2. Hydrodynamic sealing system, as claimed in claims 1, wherein it is applied to a centrifugal system (1) which includes hermetic closure means (12) for the sealing zone (9).

3. Hydrodynamic sealing system, as claimed in claim 1, wherein the double impeller (2) has a closed front wall (13) and a semi-open rear wall (14).

4. Hydrodynamic sealing system, as claimed in claim 1, wherein the double impeller (2) has a closed front wall (13) and a closed rear wall (14).

5. Hydrodynamic sealing system, as claimed in claim 1, wherein the double impeller (2) has a closed rear wall (14).

* * * * *